US005505359A

United States Patent [19]

Joecker, Jr.

[11] Patent Number: 5,505,359

[45] Date of Patent: Apr. 9, 1996

[54] TILE CUTTER

[75] Inventor: Eduard Joecker, Jr., Wuppertal, Germany

[73] Assignee: Eduard Joecker GmbH, Wuppertal, Germany

[21] Appl. No.: 252,171

[22] Filed: Jun. 1, 1994

[30] Foreign Application Priority Data

Aug. 26, 1993 [EP] European Pat. Off. ..... 93113614

[51] Int. Cl.[6] ..... B26F 3/00

[52] U.S. Cl. ..... 225/96.5; 225/96

[58] Field of Search ..... 225/96.5, 96, 94, 225/2; 125/23.01, 23.02, 35; 269/289 R, 302.1

[56] References Cited

U.S. PATENT DOCUMENTS 4,026,262 5/1977 Yasuga ..... 225/96.5
4,515,354 5/1985 Chandler et al. ..... 269/289 R
5,303,690 4/1994 Ishii ..... 225/96.5
5,331,877 7/1994 Ishii ..... 225/96.5

FOREIGN PATENT DOCUMENTS 1175303 3/1959 France ..... 125/23.02
932640 7/1963 United Kingdom ..... 125/23.02

*Primary Examiner*—Richard K. Seidel
*Assistant Examiner*—Charles Goodman
*Attorney, Agent, or Firm*—Antonelli, Terry, Stout & Kraus

[57] ABSTRACT

A tile cutter including an elongated bottom plate having a transversely extending tile stop backing and a longitudinal breaking web disposed on the bottom plate. A slide is movably mounted along a horizontal guide above the breaking web, with the slide angle lever being pivotally mounted on the slide and including a cutting wheel, breaker head and an actuating arm. The bottom plate is divided into a front and rear bearing area which, together with the tile breaker web, form a reliable three-point support even for small tile strips by a lateral transverse recess having a width which is sufficient for enabling gripping of a tile to be cut peripherally on the edge side.

11 Claims, 4 Drawing Sheets

TILE CUTTER

FIELD OF THE INVENTION

The present invention relates to a tile cutter enabling an accurate cutting of full sized tiles and tile strips.

BACKGROUND OF THE INVENTION

Tile cutters have been proposed which include a longitudinally extending bottom plate which has a transversely extending tile stop backing and a longitudinally extending breaking web with a slide which is adaptably moved along a horizontal guide above the breaking web. An angle lever is provided on the slide, with the angle lever being pivotally mounted and including a cutting wheel, a breaker head and an actuating arm. A portion of the bottom plate on one side of the breaking web forming a tile bearing area.

A tile cutter of the aforementioned type is proposed in, for example, EP 0 052 691 A2, with such tile cutter being used extensively by tile layers as well as by do-it-yourselfers.

Conventional tile cutters are characterized by ease of handling as long as the tiles or ceramic plates of a conventional size are to be cut. The tiles are pushed down in the cutting process by one hand of the user onto the breaking web and on one side of the bottom plate and are placed against a back stop of the bottom plate, and, with the other hand of the user, the cutting wheel is drawn or pushed over the tile while scratching the glazing. A side stop for positioning the tile in this case is generally unnecessary.

In conventional tile cutters, major problems arise when narrow tiles are to be cut. The tile strips lie against the back stop with only one narrow front face. For this reason these tile strips, simply by pressing on the breaking web and the bottom plate and pressing against the back stop cannot be manually securely held in position. In the cutting process, the tile strip often slips or tilts so that the cut is no longer made at the required site.

an adjustable side stop for fixing tiles in position is proposed in, for example, FR-A-2 444 547; however, the provision of a side stop increases production costs as well as the price of the tile cutter and makes handling of the tile cutter unwieldy and time consuming.

In FR-A-1 175 303, a tile cutter is proposed which includes a substantially cross-shaped bottom plate wherein one of the transverse arms of the cross-shaped bottom plate is a tile feeding angle which can be moved and rotationally adjusted. The tile is placed on the longer cross arm of which a guide for the cutting wheel slide extends. The longer, comparatively narrow cross arm forms a flat tile bearing area which may be enlarged by a swiveling extension arm on the longitudinal side opposite the feeding angle. Neither a breaker head nor a breaking web are provided. This type of tile cutter is expensive to produce due to the separate tile positioning aids and is complicated to handle and is not suitable for cutting narrow tile strips.

SUMMARY OF THE INVENTION

The objective of the present invention essentially resides in providing a tile cutter of the aforementioned type such that with the tile cutter and without adversely affecting its conventional use, even narrow tiles can be accurately and quickly cut. With the invention it will be possible to produce a tile cutter without additional cost while maintaining overall dimensions of tile cutters.

In accordance with the present invention, a tile bearing area of the bottom plate projecting forward through a lateral transverse recess has a width sufficient to hold a tile to be cut about its periphery on a side edge and, as seen in a top view, near the path of movement of the breaker head, with the tile bearing area being divided into a front and rear bearing area which together with the breaker web form a secure three-point support for small tile strips.

The tile cutter of the present invention may be utilized in a conventional manner for cutting tiles of ordinary size but also has an advantage in that the tile cutter is also suitable for cutting narrow tiles. This is because with the cutting of narrow tiles, the tile cutter of the present invention allows the transverse recess in the bottom plate to grip the narrow tiles around their periphery on the side edge, for example, to hold the narrow tiles between a thumb and a forefinger of a user and thus in a three-point support to press on the breaking web end the two bearing areas of the bottom plate on either side of the transverse recess. By virtue of this arrangement, a more secure grip can be achieved and the narrow tile can be held exactly in the required position during a cutting process or operation. A side stop or other additional means for fixing the position of the tile is superfluous and narrow tiles or tile strips can be cut as quickly and as easily as tiles of conventional size.

Advantageously, in accordance with the present invention, the front bearing area, which lies between the transverse recess and the back stop, may be formed as a narrow strip which extends substantially parallel to the back stop, and the rear bearing area may project essentially the same width as the front bearing area away from the breaking web.

According to the present invention, the rear bearing area may be bound by one edge area of the transverse recess which is sloped to the longitudinal extension of the bottom plate. In this manner, a three-point support of greater area is offered to the tiles or tile parts to be cut as size increases.

According to a further feature of the present invention, the width of the front bearing area may be several centimeters and, for example, may be two to three centimeters. In this manner, the tile cutter can also be used for larger tiles in the conventional manner.

According to the invention, the transverse recess may be bounded by an edge area which extends essentially at a right angle to the longitudinal extension of the bottom plate and by an edge area which is sloped opposite the longitudinal extension of the bottom plate and which extends obliquely to the outside toward the longitudinal end of the bottom plate which is facing away from the tile back stop. These two edge areas of the transverse recess are capable of passing into one another via an arc shaped edge area. By means of this arrangement, an edge-side gripping possibility, which is optimal for all widths of tiles to be cut, is achieved.

Edge areas of the transverse recess are provided with a chamfer toward the top of the bottom plate, and, according to the invention, the horizontal guide and breaking web are arranged off center near one longitudinal side of the bottom plate. The bottom plate projects on its longitudinal side opposite the transverse recess above the breaking web only by a width which is substantially equal to half a width of the breaker head.

In accordance with the tile cutter of the present invention, on the corners which lie on the side of the transverse recess, the bottom plate is beveled at substantially 45°, with the bevels, when seen in a top view, project forward roughly equally near the transverse recess to the guide.

With the tile cutter of the present invention, the tile bearing area of the bottom plate is divided by the lateral transverse recess which has a width sufficient for gripping the tile to be cut peripherally on the side edge and which projects forward, when viewed from above, to near the path of movement of the breaker head into a front and rear bearing area which together with the breaking web form the secure three-point support even for small tile strips.

The tile cutter of the present invention is provided with a longitudinal bottom plate which has a tile bearing surface with a breaking web end with a slide which can move on a horizontal guide above the breaking web. An angle lever is provided on the slide, with the angle lever being pivotally mounted and including a cutting wheel, a breaker head and an actuating arm. The bottom plate is provided on one longitudinal side with a transverse recess, open on the edge, with a transverse recess having a width sufficient for gripping the tile to be cut peripherally on the edge side and which, when viewed in an overhead view, projects forward as far as close to a path of movement of the breaker head. Between the recess and the tile stop backing of the base plate, a narrow bottom plate area is provided for supporting the tile to be cut. The recess is bordered by an edge area which runs essentially transversely to the longitudinal extension of the bottom plate and by an edge area which is sloped relative to the longitudinal extension of the bottom plate and which runs towards the longitudinal end of the bottom plate facing away from the stop backing.

BRIEF DESCRIPTION OF THE DRAWINGS

The above and other objects, features and advantages of the present invention will become more apparent from the following description when taken in connection with the accompanying drawings which show, for the purpose of illustration only, one embodiment in accordance with the present invention, and wherein.

DETAILED DESCRIPTION

Figure 2:
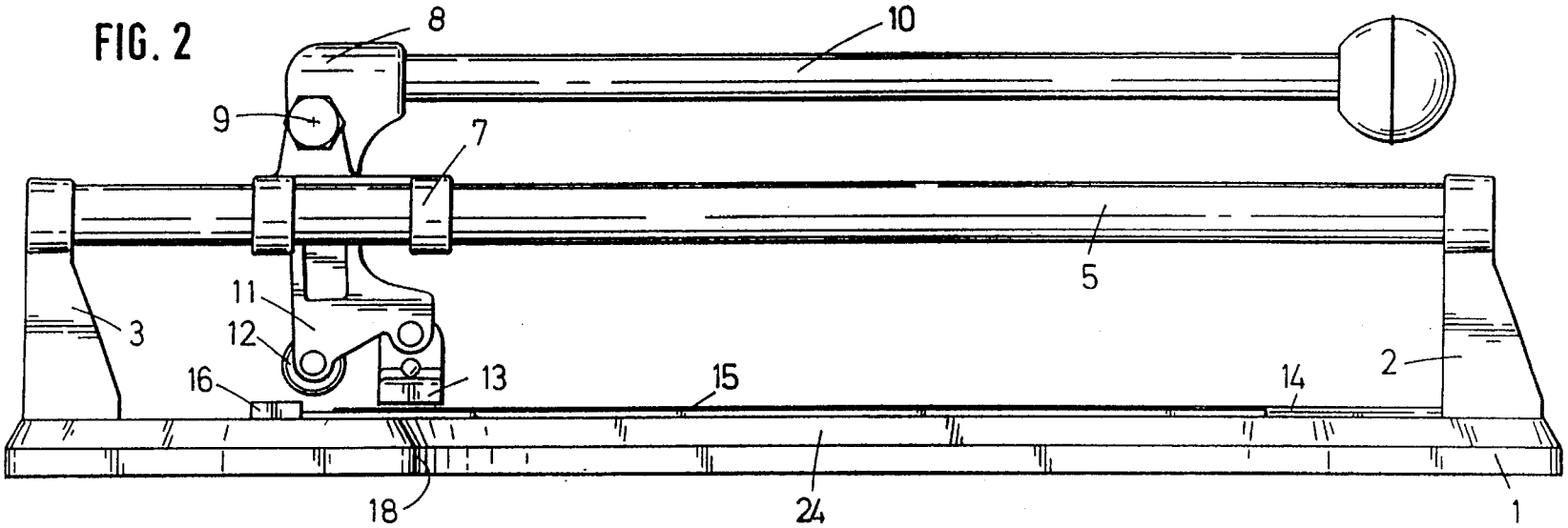
FIG. 2 is a side view of the tile cutter of FIG. 1 taken in the direction of the arrow II in FIG. 1.
Figure 3:
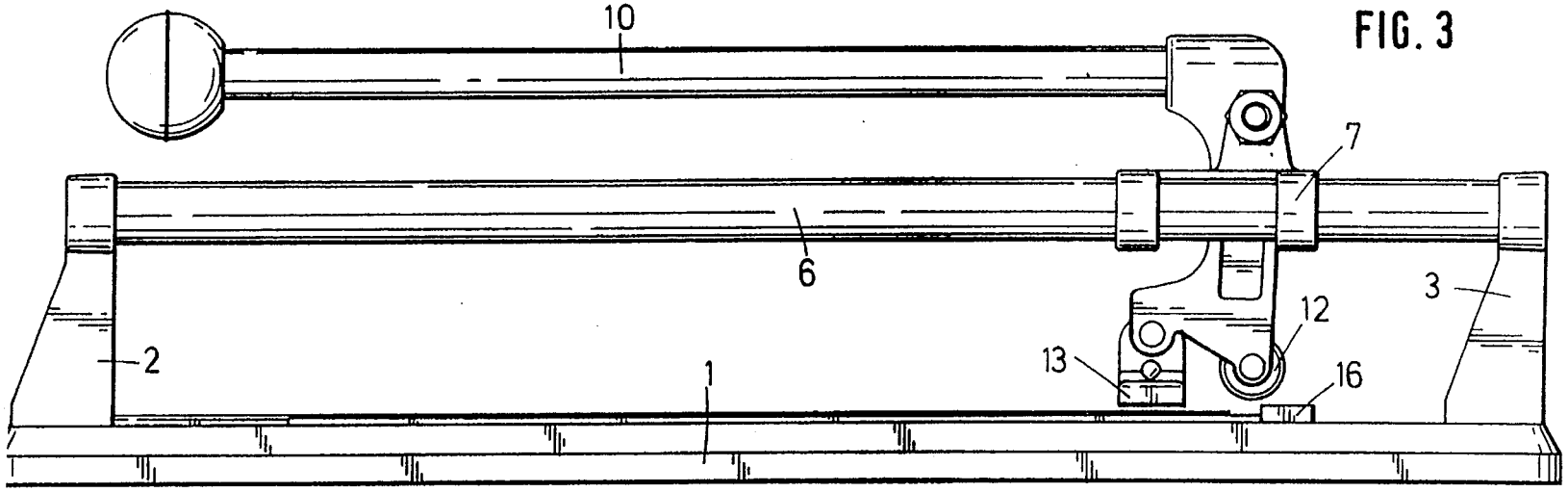
FIG. 3 is a side view of the rear of the tile cutter of FIG. 1.

Referring now to the drawings wherein like reference numerals are used throughout the various views to designate like parts, a tile cutter constructed in accordance with the present invention includes an elongated bottom plate 1 with brackets 2, 3 attached at respective end faces of the bottom plate 1 for enabling a mounting of a guide generally designated by the reference numeral 4. The guide 4 includes two guide bars 5, 6 for slidably accommodating a slide member 7 for movement with respect to the guide 4. An angle lever 8 is provided on the slide 7, with the angle lever being mounted for pivotal movement about a horizontal axis 9. The angle lever 8 includes an actuating arm 10 and a working arm 11. The working arm 11 includes a downwardly pointed end having a cutting wheel 12 shown most clearly in FIGS. 2, 3 and also includes a pivotally mounted breaker head 13.

Figure 4:
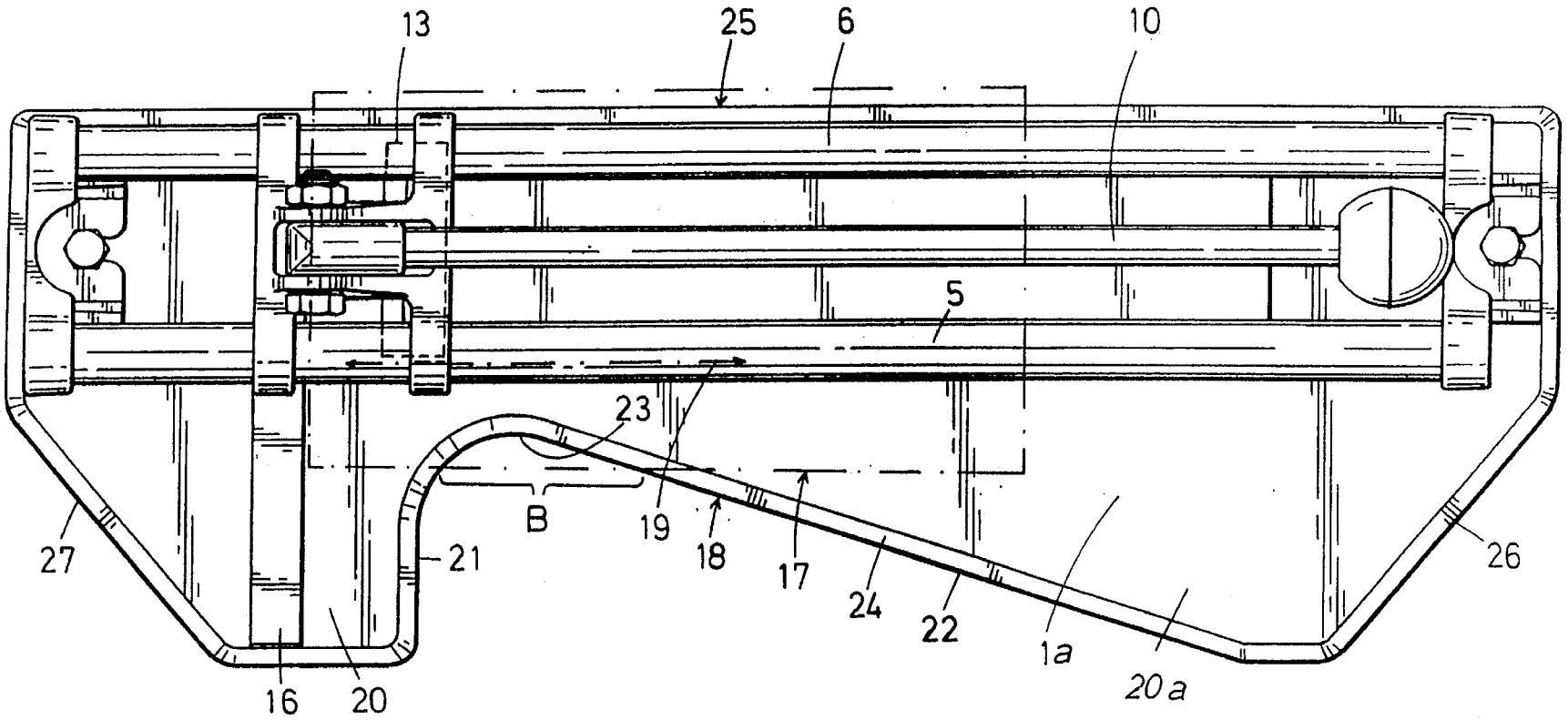
FIG. 4 is a top plan view of the tile cutter of FIG. 1.
Figure 5:
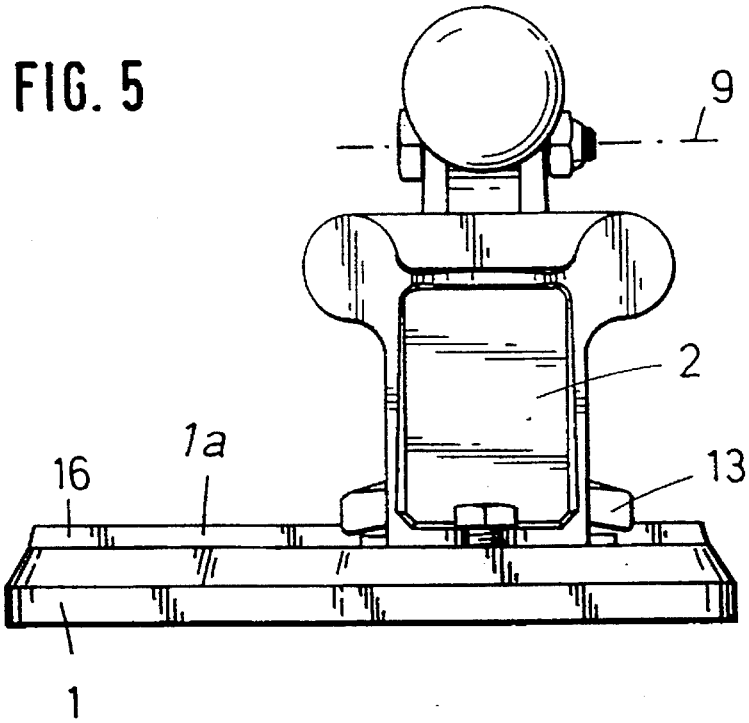
FIG. 5 is a right front end view of the tile cutter of FIG. 1.
Figure 6:
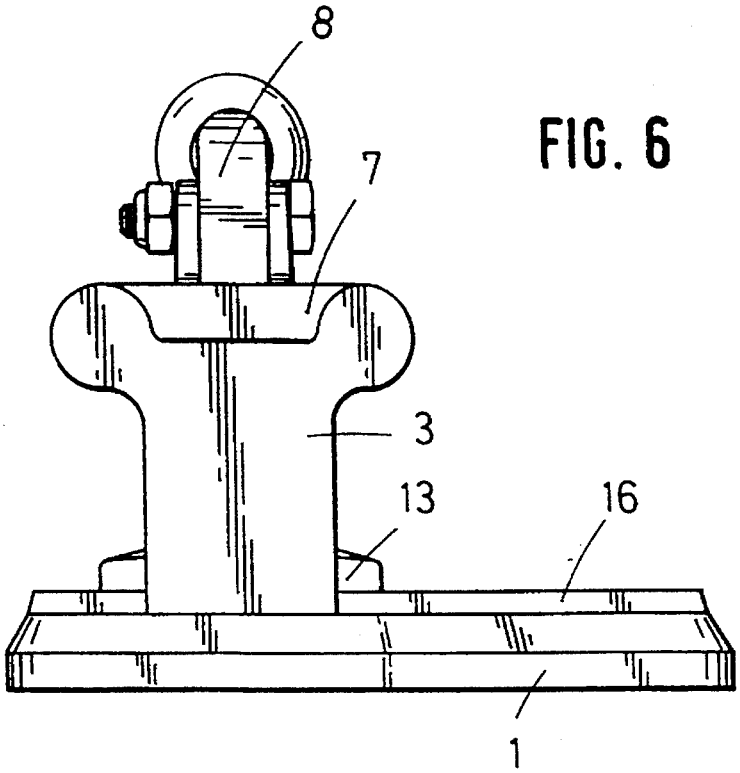
FIG. 6 is a left front end view of the tile cutter of FIG. 1.

The bottom plate 1 includes a raised or projecting breaking web 14 disposed below a path of movement of the cutting wheel 12. The breaking web 14, on either side or both sides thereof is bordered by strips 15 of soft elastic material which are attached on the bottom plate 1. A back stop plate 16 is provided at one end of the bottom plate 1, the left end in the illustrated embodiment. The back stop 16 against which a tile 17 to be cut is aligned extends transversely along the elongated bottom plate 1 as shown most clearly in FIG. 4. The horizontal guide 4 and the breaking web 14 are arranged off center near one longitudinal side 25 of the elongated bottom plate 1 and the part of the bottom plate 1 on the opposite side of the breaking web 14 forms a tile bearing area 1*a*. The tile 17 on the one side is placed on the breaking web 14 and on the other on this part of the bottom plate 1 and is held securely with the left hand of the user during a cutting process. In the cutting process, the cutting wheel 12 is pushed with the right hand of the user in the direction of the back stop 16 and then the breaking head is pressed onto the area of the scratched tile 17 adjacent to the back stop 16 in a conventional manner.

Figure 1:
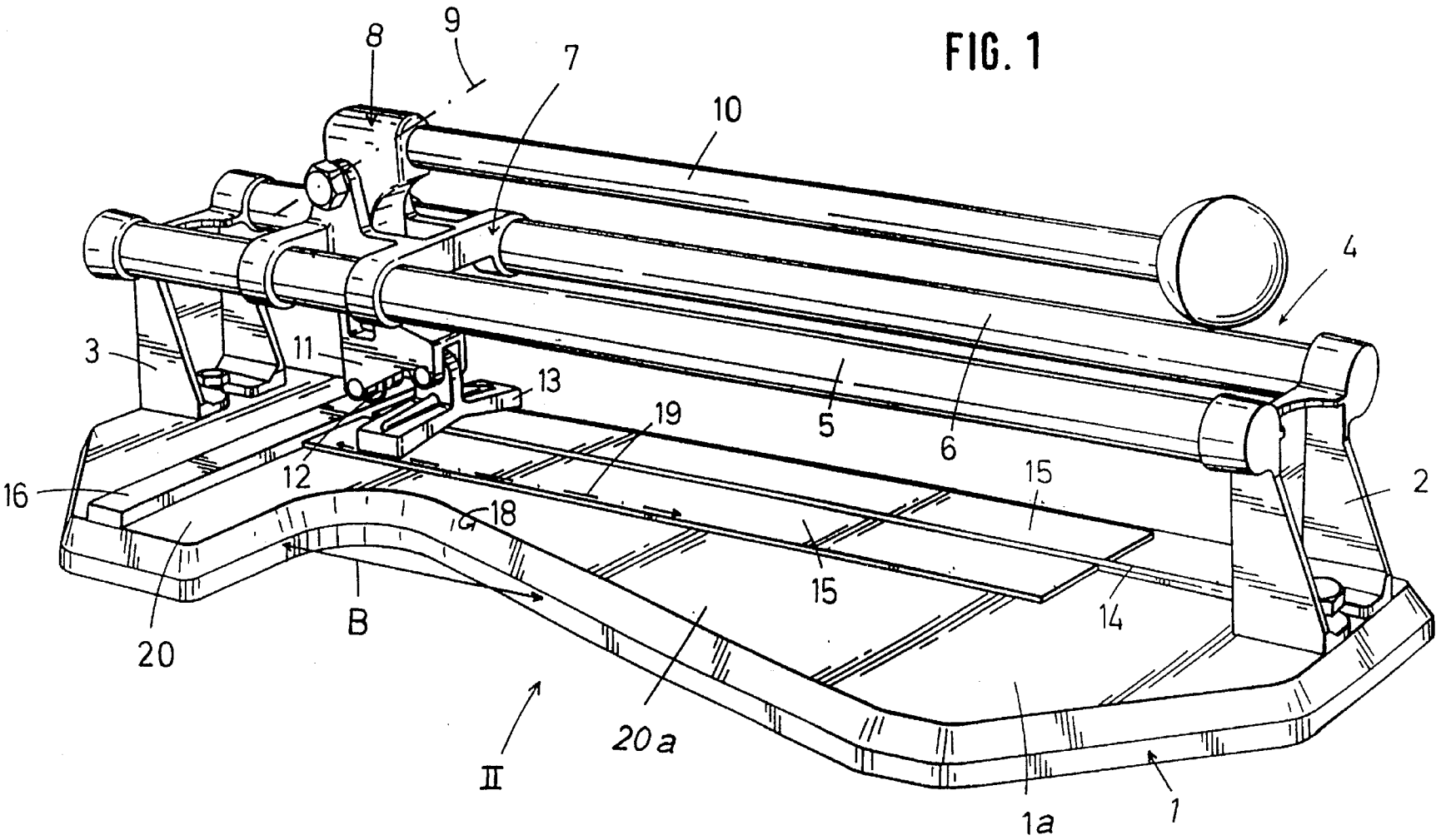
FIG. 1 is a perspective view of a tile cutter according to the invention.

In order to be able to quickly and accurately cut relatively narrow tiles 17, in accordance with the present invention, the bottom plate 1 is provided on one longitudinal side, that is, on the longitudinal side disposed to the left of FIG. 1, with a transverse recess 18 open on the edge which has a width B which is sufficient for gripping the tile 17 to be cut peripherally on the edge side and which, as viewed in an overhead view, projects forward to close or near the path of movement 19 (FIGS. 1, 4) of the breaker head 13, for example, as far as a distance of one to two centimeters. The tile 17 can thus be surrounded on its area above the transverse recess 18 between the thumb and forefinger of one hand of the user and, the cutting process, can be held or maintained as securely in the required position.

By means of the transverse recess 18, the tile bearing area 1*a* of the bottom plate 1 is divided into a front bearing area 20 which borders the back stop 16 and a rear bearing area 20*a*. The front bearing area is formed as a narrow strip roughly two to three centimeters wide which runs essentially parallel to the back stop 16. Both bearing areas 20, 20*a* project the same width away from the breaking web 14.

The transverse recess is bordered by an edge area 21 which is a first side of the transverse recess and which runs essentially at a right angle to the longitudinal extension of the bottom plate 1 and by an edge area 22 which is a second side of the transverse recess and which is sloped at approximately 20° relative to the longitudinal extension of the bottom plate 1, with the edge area 22 extending or running obliquely to the outside toward the longitudinal end of the bottom plate 1 facing away from the back stop 16. The two edge areas 21, 22 of the transverse recess 18 pass into one another via an arc-shaped edge area 23. The edge areas 21, 22, 23 of the transverse recess 18 are provided with a chamfer 24 towards the top of the bottom plate 1.

The bottom plate 1 projects on its longitudinal side 25 opposite the transverse recess 18 above the breaking web 14 only by a width which is roughly equal to one-half the width of the breaker head 13. On its corners which lie on the side of the transverse recess 18, the bottom plate 1 is beveled at roughly 45°, with the bevels 26 and 27, when viewed in an overhead view, projecting forward roughly equally near as the transverse recess 18 to the guide 4. Handling of the tile cutter when cutting whole tiles, that is for the greatest use of a tile cutter, is not adversely affected by the transverse recess 18 since the tile can be held and positioned in a tilt proof manner by its three-point support on the breaking web 14 and the two bearing areas 20, 20*a* so that additional side stops or other separate positioning aids are superfluous. Medium sized tiles or tile pieces offer an increasing three-point support which becomes larger in area by the bearing area 20*a* which gradually becomes wider.

While I have shown and described several embodiments in accordance with the present invention, it is understood that the same is not limited thereto but is susceptible to numerous changes and modifications as know to one of ordinary skill in the art, and I therefore do not wish to be limited to the details shown and described herein, but intend to cover all such modifications as are encompassed by the scope of the appended claims.

I claim:

1. A tile cutter comprising:

a longitudinally extending bottom plate;

a tile back stop mounted on the bottom plate and extending transversely to a longitudinal axis of the bottom plate;

a longitudinally extending tile breaking web disposed on the bottom plate;

a slide mounted on a horizontally disposed guide, the slide being disposed above the tile breaking web and being movable along the guide;

an angle lever pivotally mounted on the slide including a tile cutting wheel, a breaking head, and an actuating arm;

a tile bearing area disposed on the bottom plate and bordered in part by the tile back stop, the tile bearing area being divided into front and rear tile bearing areas;

a transverse recess defined by a portion of a periphery of the bottom plate located on one side of the tile breaking web, the transverse recess having first and second sides which project with an inward taper toward the tile breaking web, and wherein an innermost portion of the recess is located closer to the tile breaking web than any point on the first and second sides as measured orthogonally from the tile breaking web; and wherein the tile back stop and the first side are opposed sides of the front tile bearing area, the second side is a side of the rear tile bearing area, the second side is located a greater distance from the back stop than a distance from the back stop to the first side, the tile breaking web and the front and rear tile bearing areas form three areas of support for tiles which are cut by the tile cutter and have a tile dimension extending beyond the part of the recess measured from the tile back stop, and tiles which do not extend beyond the part of the recess measured from the tile back stop may be cut by gripping a side of the tile to be cut extending along a length of the tile to be cut.

2. A tile cutter in accordance with claim 1 wherein: a portion of the first side is essentially parallel to the tile back stop.

3. A tile cutter in accordance with claim 2 wherein: the recess includes an arc.

4. A tile cutter in accordance with claim 2 wherein: the first and second sides respectively meet first and second parts of the portion of the periphery of the bottom plate located on one side of the tile breaking web with the parts being essentially parallel to the tile breaking web.

5. A tile cutter in accordance with claim 4 wherein: the recess includes an arc.

6. A tile cutter in accordance with claim 4 wherein: a distance between the tile back stop and the portion of the first side which extends essentially parallel to the back stop is in a range of several centimeters.

7. A tile cutter in accordance with claim 6 wherein: the recess includes an arc.

8. A tile cutter in claim 6 wherein: the range is between two and three centimeters.

9. A tile cutter in accordance with claim 8 wherein: the recess includes an arc.

10. A tile cutter in accordance with claim 1 wherein: the recess includes an arc.

11. A tile cutter in accordance with claim 1 wherein: the portion has a chamfer extending toward a top surface of the bottom plate.

* * * * *